US005443411A

United States Patent [19]

Rouyer et al.

[11] Patent Number: 5,443,411

[45] Date of Patent: Aug. 22, 1995

[54] DEVICE FOR MACHINING AND FACING RESILIENT MATERIALS

[75] Inventors: Louis Rouyer, Clamart; Jacques Bastin, Sainte-Genevieve des Bois, both of France

[73] Assignee: Createc Rollers, Sainte-Genevieve des Bois, France

[21] Appl. No.: 70,433

[22] PCT Filed: Dec. 5, 1991

[86] PCT No.: PCT/FR91/00972

§ 371 Date: Oct. 18, 1993

§ 102(e) Date: Oct. 18, 1993

[87] PCT Pub. No.: WO92/10331

PCT Pub. Date: Jun. 25, 1992

[30] Foreign Application Priority Data

Dec. 5, 1990 [FR] France ..... 90 15220

[51] Int. Cl.[6] ..... B24B 49/00

[52] U.S. Cl. ..... 451/11; 451/24; 451/242

[58] Field of Search ..... 51/103 L, 238 S, 238 R, 51/50 R, 49, 105 R, 324, 289 R, 206 R, 2 C, 2 H, 2 K, 165.91, 165.90, 165.76; 451/11, 24, 242, 246, 243, 49

[56] References Cited

U.S. PATENT DOCUMENTS

| | | | |
|---|---|---|---|
| 1,575,968 | 3/1926 | Bryant | 51/2 H |
| 1,709,671 | 4/1929 | Kearns | 51/105 R |
| 3,324,607 | 6/1967 | Niemiec . | |
| 3,427,755 | 2/1969 | Levesque et al. | 51/105 R |
| 3,743,490 | 7/1973 | Asano et al. | 51/238 S |
| 4,293,913 | 10/1981 | Nishimura et al. | 364/474 |
| 4,404,772 | 9/1983 | Snyder | 51/105 R |
| 4,519,279 | 5/1985 | Ruggeri | 82/38 R |
| 4,663,892 | 5/1987 | Smith et al. | 51/289 R |
| 4,711,054 | 12/1987 | Tsujiuchi et al. | 51/165.77 |
| 4,815,239 | 3/1989 | Sommer et al. | 51/165.71 |
| 4,823,657 | 4/1989 | Welin-Berger | 82/162 |
| 5,020,282 | 6/1991 | Okajima et al. | 51/206 R |
| 5,027,562 | 7/1991 | Kobayashi et al. | 51/165.77 |
| 5,076,022 | 12/1991 | Ohta et al. | 51/165.71 |
| 5,148,827 | 9/1992 | Masters | 137/209 |

FOREIGN PATENT DOCUMENTS

| | | | |
|---|---|---|---|
| 567711 | of 1931 | Germany | 51/238 S |
| 62-228361 | 10/1987 | Japan . | |
| 1150996 | 5/1969 | United Kingdom . | |
| 2185918 | 8/1987 | United Kingdom . | |

*Primary Examiner*—Maurina T. Rachuba

*Attorney, Agent, or Firm*—Schweitzer & Cornman & Gross

[57] ABSTRACT

A grinding device is provided for machining and facing workpieces made of resilient or semi-resilient materials. Said device comprises means (31) for holding the workpiece being processed after the machining operation to allow facing thereof. Machining can be improved by allowing limited drift of the workpiece, providing a flexible rotational drive, applying back pressure and using a recessed grinding wheel. This device can be used particularly for machining and facing drive rollers for office machines.

12 Claims, 2 Drawing Sheets

DEVICE FOR MACHINING AND FACING RESILIENT MATERIALS

BACKGROUND OF THE INVENTION

The present invention relates to a grinding device for the machining, including facing, of resilient or semi-resilient materials.

Two maching techniques based on grinding wheels are known: the so-called "scanning" technique in which a grinding wheel, the width of which is less than the length of the workpiece to be machined, "scans" said workpiece by being moved in front of it at the desired distance, and the so-called "in-feed" technique in which the workpiece to be machined is cut by a grinding wheel, the width of which is at least equal to the length of this workpiece, so as to machine the latter without having to move it sideways.

Each of these techniques possesses advantages and disadvantages.

The "scanning" technique has the double advantage over the "in-feed" technique that it enables smaller grinding wheels to be used and that it allows workpieces made of resilient or semi-resilient materials to be machined.

In the "in-feed" technique, the relative movement between grinding wheel and workpiece being machined is radial in relation to the latter, and, if the workpiece is made of a material which is that bit resilient, surface compression inevitably occurs which prevents having complete control not only over the correct dimensioning of the workpiece, but also over its final surface condition. In addition, in the case of somewhat long workpieces, the pressure exerted by the grinding wheel always causes the workpiece to bend, to a greater or lesser degree, during machining and the result of this bending is to give the finished workpiece, to a greater or lesser extent, an undesirable crown.

This is why, for machining workpieces made of resilient or semi-resilient materials, the "scanning" technique is used.

However, the latter has, compared with the "in-feed" technique, the disadvantage of requiring a longer time insofar as it is absolutely necessary that the grinding wheel "scans" the entire length of the workpieces to be machined.

This drawback may certainly be overcome to a certain degree by increasing the number of machining machines supervised by a given person. However, this means an additional investment running the risk, ultimately, of canceling out any economic benefit from this increase in production.

SUMMARY OF THE PRESENT INVENTION

The object of the present invention is to provide a grinding device for the machining, including facing, of workpieces made of resilient or semi-resilient materials, enabling the "in-feed" technique to be used while still maintaining the advantages of the "scanning" technique as regards meeting dimensional requirements and final surface condition.

For this purpose, the grinding wheel operating in "in-feed" mode is equipped with means which are capable of ensuring, for a certain time, at the end of a machining operation, that the workpiece being machined is held in such a way that its rotation spindle is, at its supports, at a distance in relation to the rotation spindle of the grinding wheel equal to the sum of the theoretical radius of the desired workpiece and the radius of the grinding wheel.

This arrangement makes it possible, after rough-machining, to obtain a workpiece of precise dimensions, and therefore having the precise shape, and of as fine a surface condition as desired, this being so even for workpieces made of resilient materials.

In an advantageous embodiment exhibiting this characteristic, it is an airdraulic device which holds the workpiece being machined, subject to information from a feed via a timing device, when said workpiece reaches the desired position.

According to a second characteristic, the device according to the invention is provided with means allowing, during the rough-machining period, a slight drift of the rotation spindle of the workpiece being machined.

In an advantageous embodiment exhibiting this characteristic, two open bearing surfaces are provided, each of which is constituted by a component which includes two surfaces arranged perpendicularly to each other, on which surfaces the spindle of the workpiece being machined is capable of being supported along two of its generatrices, on lines located at least 180° apart in relation to said spindle of the workpiece, means being provided for preventing this spindle from escaping from these bearing surfaces if said workpiece drifts.

This thus ensures both a better cutting, by the grinding wheel, of the workpiece being machined, and a reduction in the friction of the spindle on its bearing surfaces.

According to another advantageous characteristic of the invention, the workpiece being machined is driven in rotation by a flexible drive mechanism which, during machining, allows the spindle carrying said workpiece to bend without difficulty.

According to another advantageous characteristic, in the case of the machining, including facing, of the drive rollers of machines used in an office environment, an adjustable bearing surface is provided which can exert, on the roller being machined, a controlled elastic thrust force which is exerted counter to the pressure exerted by the grinding wheel.

It is thus possible to reduce, cancel out or indeed reverse, the bending of said roller being machined.

Another means for reducing the pressure exerted by the grinding wheel on the workpiece being machined consists, according to the invention, in using a grinding wheel having recesses over its entire periphery, which are arranged so as to produce, together with the active-surface portions, an alternation such that the active-surface/recess ratio is constant over any plane perpendicular to a generatrix of the grinding wheel and passing through any point of this generatrix.

Apart from thus obtaining a lower pressure on the workpiece being machined, in addition and by virtue of the recesses, the grinding wheel does not become glazed, and this being so with an increase in the abrasive effect by virtue of the downstream edges of the recesses which constitute as many cutting edges.

According to another characteristic of the invention, the cutting edges of the recesses at the surface of the grinding wheel form, together with a generatrix of said grinding wheel, an angle other than zero, the advantage of such an arrangement being less wear of the grinding wheel as well as a less severe cutting of the workpiece from which matter is to be removed.

In an advantageous embodiment of the invention, the recesses of the grinding wheel are constituted by helical slots extending over the entire length of the grinding wheel, these allowing a technically less complex production and increasing the non-glazing effect of the recesses in the grinding wheel.

Other characteristics and advantages will be apparent from the description which follows of an exemplary embodiment of the invention, in conjunction with the attached drawings, this example being given purely by way of indication and with no limitation implied.

DETAILED DESCRIPTION OF THE INVENTION

Figure 1:
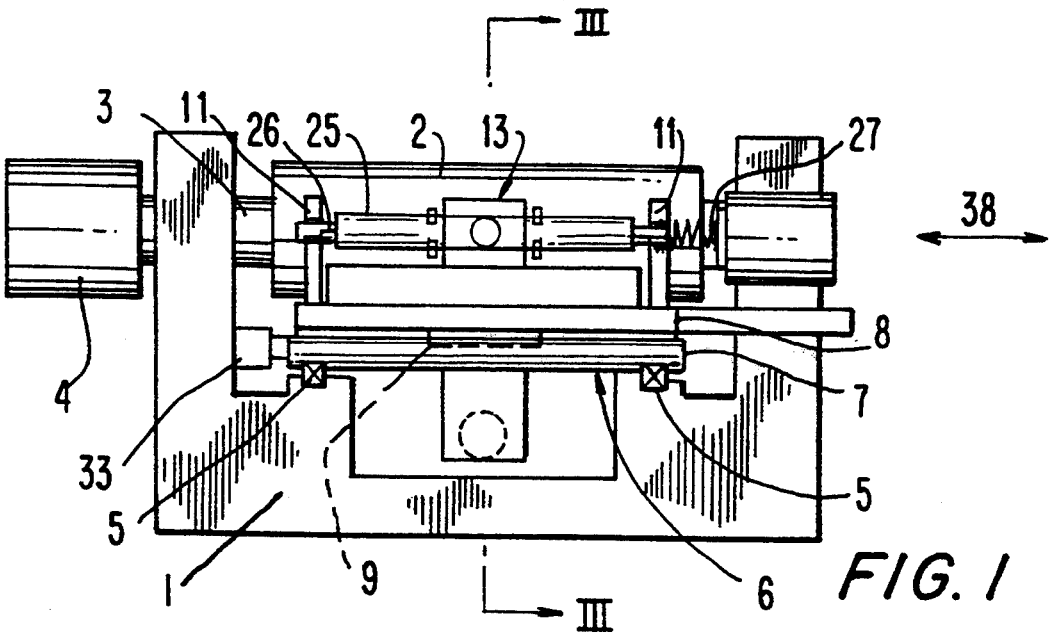
FIG. 1 is a front view of a machining device according to the invention.
Figure 2:
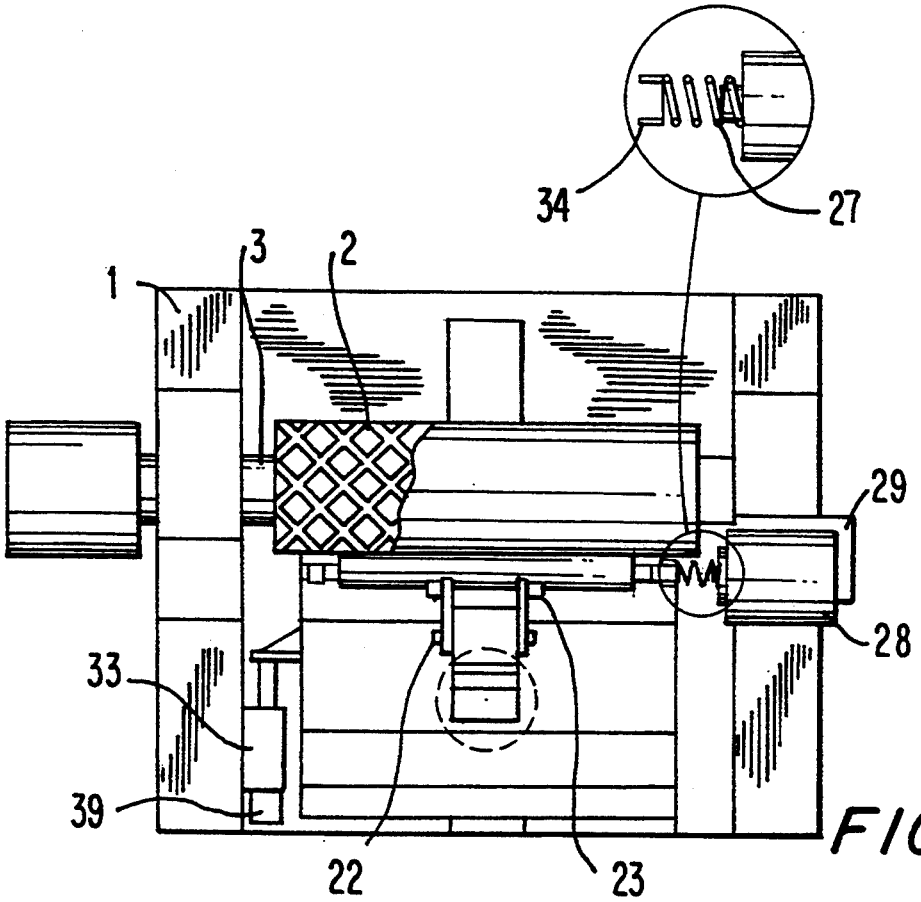
FIG. 2 is a plan view of FIG. 1.
Figure 3:
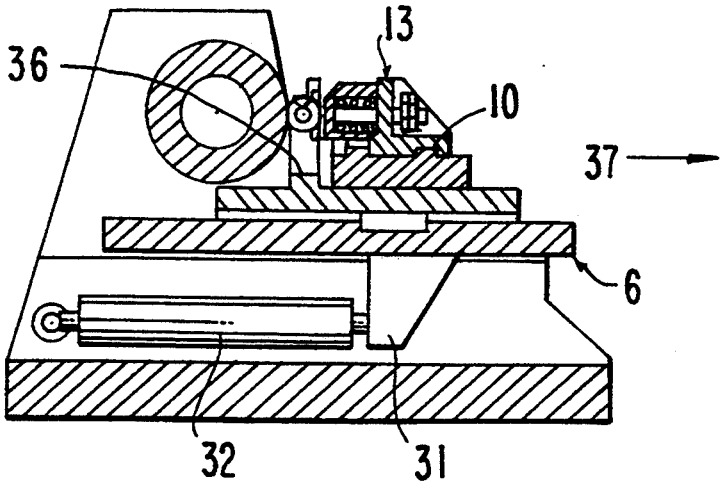
FIG. 3 is a sectional view along III—III of FIG. 1.

In FIGS. 1 to 3, the apparatus comprises a frame 1 carrying a grinding wheel 2 which rotates about a spindle 3 which is rigidly attached to the output shaft of a motor 4 having two positions, one in which only the spindle and the grinding wheel are driven in rotation, and the other in which they are simultaneously set into an axial to-and fro movement (arrow 38).

The grinding wheel 2 has a 15-centimeter diameter and has recesses over its entire periphery, which are constituted by crossed helical slots of 10-millimeter depth arranged in such a way that the active-surface/recess ratio is constant over any plane perpendicular to a generatrix of the grinding wheel, passing through any point of this generatrix. In this case this ratio is 1, but it may vary however, preferably lying between 0.8 and 1.2.

A device for sucking up the chips and dust has not been drawn because it does not form part of the invention. However, it is obvious that the grinding wheel 2 has to be located within such a system.

A movable assembly 6, consisting of two plates 7 and 8, is capable of sliding over the base of the frame 1 by virtue of two rails 5 having crossed rollers interacting with two slots provided on the plate 7.

The plate 7 possesses an operating crosshead 31 rigidly attached to the movable part of an airdraulic device 32 controlled, via a timing device 39, by a feed 33.

The plate 8, mounted so as to rotate on the plate 7 by virtue of a pivot 9, possesses an angular locking device which is not shown because it does not form part of the invention. On its upper part, it carries two rails 10 perpendicular to the rails 5, and two supports 11 and, on the side, a stage 29 on which an electric motor 28 is arranged.

Figure 4:
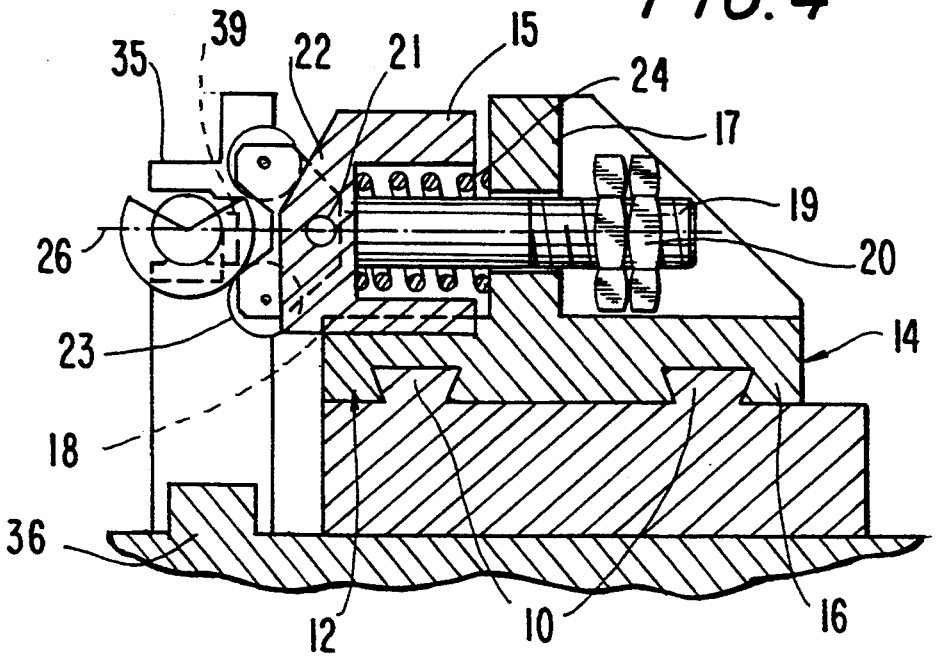
FIG. 4 shows, on a larger scale, a detail of FIG. 3.

The rails 10 enable a movable element 13 (see FIG. 4), consisting essentially of two slides 14 and 15, to move parallel to the spindle 3 of the grinding wheel.

The slide 14 comprises a sole-plate 16 and a heel 17, the sole-plate 16 carrying, on its upper surface, a guide rail 18 and, on its lower surface, two slots 12 corresponding to the two rails 10 of the plate 8.

The slide 15 carries, firstly, a slot corresponding to the guide rail 18 of the slide 14, secondly, a threaded rod 19 which passes freely through the heel 17 of said slide 14 and which is equipped with two nuts 20 at its end and, thirdly, a pin 21 about which two double levers 22, each carrying two free wheels 23, rotate freely.

A spring 24 is slipped over the threaded rod. 19 and bears, on one side, on the heel 17 and, on the other side, on the rear of the slide 15.

The supports 11 are arranged, in an adjustable manner, on a rail 36 parallel to the rails 10 on which the movable element 13 moves. Their heads are-constituted by an asymmetric notch constituting a bearing surface which is open to receive the spindle 26, the notch being formed by two surfaces arranged perpendicular to each other, namely the horizontal upper surface of the support and the side of a vertical projection 39.

A movable stop 35, the function of which will be explained below, is provided above each support.

A roller 25 is shown being machined. It is mounted on a spindle 26 laid on the heads of the supports 11, the movable Stops 35 being arranged, by means which are not shown because they do not form part of the invention, at a certain distance from the spindle 26 and having the effect of preventing it from escaping from the supports 11 while allowing it to drift slightly.

Moreover, the spindle 26 is rigidly attached, by means of a fitting device 34, to a flexible drive mechanism 27 constituted by a spring which is itself rigidly attached to the output shaft of the motor 28 carried by the stage 29 of the plate 8.

Under these conditions, the operation is carried out as explained below.

The movable assembly 6 is moved back in the direction of the arrow 37 (FIG. 3) and the following operations are performed:

- the position of the supports 11 on the rail 36, and that of the movable element 13 on the rails 10, are adjusted as a function of the distribution of the masses on the spindle 26;
- the position of the movable assembly 6 and the feed 33 are adjusted as a function of the desired dimensions;
- the stiffness of the spring 24 is adjusted as a function of the desired shape of the roller;
- the timing device 39 is adjusted as a function of the time during which the airdraulic device will be held in position in order for the facing to be effected;
- one end of the spindle 26 is fixed in the fitting device 34;
- said spindle is placed on the supports 11;
- the stops 35 are positioned;
- the motor 4 is switched on in the position in which both the rotation of the grinding wheel 2 and the axial to-and-fro movement thereof are effected, and the motor 28 which drives the roller 25 in rotation in the opposite direction to that of the grinding wheel 2 is switched on;
- the airdraulic device 32 is started.

This causes the assembly 6 to move forward towards the grinding wheel 2 until the roller 25 comes into contact with the latter.

The machining commences, each cutting element of the grinding wheel acting, on account of the to-and-fro movement into which it is set, over an area of the roller 25 and not just along a line, thereby improving the uniformity of the machining. Moreover, the presence of the recesses over the grinding wheel helps the chips and dust to be sucked up, thereby ensuring that the grinding wheel remains permanently unglazed.

The latter exerts, on the roller being machined, a pressure which depends on the thrust force caused by the airdraulic device, and this pressure tends to cause the spindle 26 to bend, the only result of which can be that the roller 25, after machining is complete, ends up with a crowned profile.

It is here that the action of the movable element 13 comes into play, which, as a function of its position in relation to the bearing surfaces on the supports 11, of the position of the slide 15 in relation to the rotation spindle of the roller 25 and of the stiffness of the spring 24, exerts a back-pressure the effects of which will vary depending on its magnitude. This back-pressure may completely cancel out the bending of the spindle 26 and thus enable a perfectly cylindrical roller to be obtained. It may only partially cancel it out and thus reduce only the crown which would have been obtained on the roller 25 with the pressure of the grinding wheel. Finally, if it is greater than the .pressure of the grinding wheel, it may enable a roller to be produced in the form of a roller cradle, that is to say with a smaller diameter at its middle than at its ends.

When the feed 33 establishes that the rotation spindle of the roller 25 is, at its bearing surfaces, at a distance from the rotation spindle of the grinding wheel 2 equal to the sum of the theoretical radius of the desired workpiece and the radius of said grinding wheel, the airdraulic device stops the assembly 6, holding. therefore the bearing surfaces of the roller 25. At that moment the timing device 39 starts, and the machining continues in this position since the roller continues to rotate, as does the grinding wheel 2. However, if it is desired to give a non-cylindrical shape to the roller 25, the operation of the to-and-fro movement of the grinding wheel 2 is stopped.

As the machining of the roller 25 continues however, its diameter decreases and the pressure of the grinding wheel on it therefore also decreases until it completely disappears. When all radial pressure on the roller being machined has disappeared, the facing is performed to the desired dimensions and grain, irrespective of the resilience characteristics.

For a grinding wheel of 15-centimeter diameter rotating at 9,000 revolutions per minute and a workpiece of 4-centimeter diameter rotating at 30 revolutions per minute, for a 50 Shore hardness, it may be reckoned that the time during which the workpiece will be allowed to rotate after having reached the defined position will preferably lie between 10 and 30 seconds, depending on the desired fineness of grain.

Once the set time has elapsed, the timing device 39 causes the movable assembly 6 to move back. The motor 28 is stopped. The roller 25 is withdrawn and uncoupled from its flexible drive mechanism.

A new cycle may commence.

If a tapered roller is to be machined, it suffices firstly to adjust the angular position of the plate 8 in relation to the grinding wheel as a function of the desired angle, and the following operations are the same as for a cylindrical roller.

It is understood that it is possible, without departing from the scope of the invention, to modify constructional and/or operating details so as to obtain the same results.

Thus, the recesses of the grinding wheel 2 could be produced differently from the crossed helical slots. They could, for example, be the reverse of the embodiment illustrated by the figures, the slots becoming the active surface of the grinding wheel and the lozenges becoming recesses which would then be discontinuous.

The flexible drive mechanism 27 could of course be replaced by a flexible cable or even by a device having one or more cardan drives.

In the case of workpieces to be machined which are greater than 40 centimeters in length, it would be possible to provide either one movable element with more than two sets of free bearing wheels, or a plurality of elements, in order to distribute the back-pressure more evenly over the roller being machined.

Not only is it not excluded to be able, under certain conditions, to replace the to-and-fro movement of the grinding wheel by an identical to-and-fro movement of the workpiece being machined, but it is also possible to carry out the invention without relative movement other than their rotation.

We claim:

1. A cylindrical grinding device for the machining and the facing of a workpiece made of resilient or semi-resilient material by the "in-feed" technique by using a grinding wheel of width at least equal to the length of said workpiece to be machined, characterized in that said device includes (a) means (32, 33, 39) which are capable of ensuring, for a certain time at the end of a machining operation, that a workpiece (25) is held in a position in which its rotation spindle (26) is located, at spindle supports (11), at a distance in relation to the rotation spindle (3) of the grinding wheel (2) equal to the sum of the theoretical radius of the desired finished workpiece and the radius of said grinding wheel; and (b) flexible drive means (27) allowing, during the rough-machining period, a slight drift of the rotation spindle (26) of the workpiece (25) being machined.

2. Device according to claim 1, characterized in that said means include a airdraulic device (32), controlled by a feed (33) and a timing device (39), and acting on a movable element (6) supporting the workpiece (25) being machined, in order to hold said movable element, subject to information from said feed (33), for a time defined by said timing device (39).

3. Device according to claim 1, characterized in that it comprises means (13) capable of exerting, on the workpiece (25) being machined, a controlled elastic thrust force which is exerted counter to the pressure exerted by the bearing surface of the workpiece on the grinding wheel (2).

4. Device according to claim 3, characterized in that said means (13) comprise a movable element (13) comprising a set of free wheels (23) capable of bearing elastically on the workpiece (25) being machined.

5. Device according to claim 1, characterized in that it includes motor means (4) capable of creating a relative to-and-fro movement, parallel to the spindle (3) of the grinding wheel (2), between the latter and the workpiece (25) being machined.

6. Device according to claim 5, characterized in that said motor means (4) cause an axial to-and-fro movement of the grinding wheel (2).

7. Device according to claim 1, characterized in that said flexible drive means (27) include a flexible drive mechanism (27) between the workpiece being machined and the motor means (28) driving the latter in rotation.

8. Device according to claim 1 characterized in that it includes two open supports (11) constituted by two surfaces perpendicular to each other and each support receiving one end of the spindle (26) of the workpiece

(25) being machined and in that two stops (35) are provided at these supports in order to prevent said spindle (26) from escaping from them if said workpiece (25) drifts while it is being machined.

9. Device according to claim 1, characterized in that the grinding wheel (2) has recesses over its entire periphery, which are arranged so as to produce, together with the active-surface portions, an alternation such that the active-surface/recess ratio is constant over any plane perpendicular to a generatrix of the grinding wheel and passing through any point of this generatrix.

10. Device according to claim 9, characterized in that the active-surface/recess ratio lies between 0.8 and 1.2.

11. Device according to claim 10, characterized in that the cutting edges of the recesses at the surface of the grinding wheel form, together with a generatrix of said grinding wheel, an angle other than 0°.

12. Device according to claim 11, characterized in that the recesses of the grinding wheel are constituted by helical slots.

* * * * *